United States Patent [19]

Friese et al.

[11] Patent Number: 4,938,779

[45] Date of Patent: Jul. 3, 1990

[54] CHROME TANNING OF LEATHER WITH REDUCED WASTE OF CHROMIUM

[75] Inventors: Hans-Herbert Friese, Monheim; Emil Ruscheinsky, Leverkusen; Rudolf Zauns, Duesseldorf, all of Fed. Rep. of Germany

[73] Assignee: Henkel Kommanditgesellschaft auf Aktien, Duesseldorf, Fed. Rep. of Germany

[21] Appl. No.: 376,262

[22] Filed: Jul. 6, 1989

[30] Foreign Application Priority Data

Jul. 6, 1988 [DE] Fed. Rep. of Germany ..... 3822823

[51] Int. Cl.[5] ..... C14C 3/06

[52] U.S. Cl. ..... 8/94.27; 8/94.19 R

[58] Field of Search ..... 8/94.27, 94.19 R

[56] References Cited

U.S. PATENT DOCUMENTS 4,272,242 6/1981 Plapper et al. ..... 8/94.19 R 4,715,861 12/1987 Lotz et al. ..... 8/94.18

FOREIGN PATENT DOCUMENTS 2732217 2/1979 Fed. Rep. of Germany .

OTHER PUBLICATIONS

Das Leder, 26, 21–31 (1975); Das Leder, 34, 89–93 (1983).

*Primary Examiner*—Paul Lieberman

*Assistant Examiner*—John F. McNally

*Attorney, Agent, or Firm*—Ernest G. Szoke; Wayne C. Jaeschke; Norvell W. Wisdom, Jr.

[57] ABSTRACT

The efficiency of chromium utilization in chrome tanning of hides to make leather is greatly improved by performing the preliminary neutralization of the acid tanning liquor in the presence of an aldehydo or keto acid, before conventional subsequent neutralization with an alkali aluminum silicate. Most preferably, a combination of glyoxylic acid and magnesium oxide is used for the preliminary neutralization.

19 Claims, No Drawings

CHROME TANNING OF LEATHER WITH REDUCED WASTE OF CHROMIUM

FIELD OF THE INVENTION

The present invention relates to a chrome tanning process for leather, with which full tanning is obtained and nearly the entire chrome content of the tanning liquor remains in the tanned leather, instead of being lost in substantial proportions in residual tanning liquor.

STATEMENT OF RELATED ART

In the production of chrome-tanned leathers by conventional processes, approximately 70 to 80% of the chromium available in the tanning liquor with which the hide or pelt to be tanned is in contact is retained in the leather formed by tanning, depending on the method. The remaining 20 to 30% of the chromium in the tanning liquors is left in the so-called residual liquor, which can be purified only at considerable expense.

Both for ecological and for economic reasons, there has been no shortage of attempts in the past to improve the chrome uptake of the hides being tanned and to reduce the quantity of chrome required for boil-proof tanning.

To improve chrome utilization, recycling processes were proposed, for example, in "Das Leder" 26, 21 to 31 (1975), in which the residual liquors were reused for tanning after addition of fresh chrome salts or after precipitation and other processing to produce chrome tanning agents. However, these processes are attended by the disadvantage that leather fibers and unwanted salts accumulate in the tanning liquors, so that optimal tanning results can no longer be obtained. In addition, these processes are very complicated to carry out.

According to "Das Leder" 34, 89 to 93 (1983), efficient utilization of the chromium in the tanning liquor is obtained by using magnesium oxide and dicarboxylic acids for preliminary neutralization and sodium aluminum silicates for final neutralization. In addition, it is known from DE-OS 35 16 842 that the use of glyoxylic acid in the pickle leads to an improvement in chrome utilization efficiency in tanning liquors.

An object of the present invention is to develop a chrome tanning process with which even higher utilization of the chromium content of tanning liquors is obtained than in known processes.

DESCRIPTION OF THE INVENTION

In this description, except in the working examples or where otherwise expressly stated to the contrary, all numbers specifying amounts of materials or conditions of processing or use are to be understood as modified by the term "about".

The invention is based on the surprising observation that the degree of exhaustion of chromium in tanning liquors is considerably improved if the preliminary neutralization of the tanning liquor is carried out with neutralizing agents in the presence of aldehydo and/or keto acids.

The chromium salts and other solid ingredients noted herein are dissolved in water to make up the treating or tanning liquor, which is acidic in the early stages of tanning but is eventually neutralized at least in part. The amount of water used is generally not important, provided that it is sufficient to dissolve the other ingredients of the treating liquor and thoroughly wet the hides to be tanned. (The word "hide" as used herein is to be understood as including the words "pelt" and "skin", to the extent that any distinction between the terms is recognized in the leather making art.) Accordingly, the amounts of ingredients are usually specified below as percentages by weight of the weight of the hides to be tanned. Irrespective of the actual stage of the process concerned, the weight of hides to be used in calculating these percentages is the weight of the hides after liming, deliming, and bating but before exposure to salt and pickling. This reference weight of the hides applies to the claims as well as to the remainder of this specification.

In the present invention, hides pickled with formic acid and/or sulfuric acid are tanned with 0.5 to 12% by weight of chromium (III) salts, based on the hide or pelt weight to be tanned; the tanning liquor, or more specifically at least that part of the tanning liquor remaining in the now tanned hides, is partially neutralized to a pH value of 3.6 to 4.3 with neutralizing agents in the presence of aldehyde and/or keto acid(s); and the partially neutralized tanning liquor is then further neutralized to a pH value of 4.2 to 5.5 with alkali aluminum silicates. The initial partial neutralization is preferably carried out in the presence of glyoxylic acid.

The process according to the invention is distinguished by a very high degree of exhaustion of the chrome tanning agents, with the result that the concentration of the chromium (III) salts in the effluent residual tanning liquor can be distinctly reduced by comparison with known chrome tanning processes. The residual chrome content of the residual tanning liquors can be reduced to values below 0.2 g of $Cr_2O_3$ per liter of residual tanning liquor. The quality of the wet leather in the blue ("wetblues") after a tanning process according to this invention is distinctly improved. The grain pattern is finer and the color of the wet leather in the blue is lighter than in conventional tanning processes in which the initial partial neutralization step is carried out in the presence of dicarboxylic acids.

The tanning of hides pickled with formic acid and/or sulfuric acid is carried out in a known manner with chromium (III) salts, for example with chromium (III) sulfates; basic chromium (III) sulfates; and/or chromium salts with organic acids, such as formic acid or acetic acid, or with masked chromium (III) salts; the chromium (III) salts may be used in the pickle bath or in a separate tanning liquor. Quantities of 0.5 to 12% by weight and preferably of 3 to 6% by weight, based on hide weight, of chromium (III) salts are used. The tanning liquor may contain from 0.5 to 3.0% by weight, based on hide weight, of electrolyte-stable oiling agents, for example sulfited fish oil, or from 0.5 to 3.0% by weight, based on hide weight, of mixtures of electrolyte-stable oiling agents and surfactants, such as $C_{12-18}$ alkyl sulfates.

The initial partial neutralization of the tanning liquors is preferably carried out with 0.3 to 0.7% by weight, based on hide weight, of neutralizing agents in the presence of, preferably, 0.3 to 4.0% by weight and, more preferably, 0.5 to 2.0% by weight, based on hide weight, of aldehydo and/or keto acids, such as pyruvic acid and/or glyoxylic acid. Suitable and preferred neutralizing agents are, for example, magnesium oxide, dolomite, alkali carbonates, alkali bicarbonates and/or alkaline earth carbonates. However, magnesium oxide is most preferred.

The further neutralization of the tanning liquor to pH values of 4.2 to 5.5 and preferably to pH values of 4.5 to 5.0 is carried out with 0.5 to 3.0% by weight and preferably with 1.0 to 2.0% by weight, based on hide weight, of alkali aluminum silicates. The alkali aluminum silicates, preferably sodium aluminum silicates, are added to the tanning liquors either in solid form or in the form of aqueous dispersions. The alkali aluminum silicates are obtainable by known methods, for example by the method described in DE-OS 27 32 217. The temperature of the tanning liquor after addition of the alkali aluminum silicates preferably is between 30° and 50° C. and more preferably between 35° and 45° C.

Any type of animal hide, including for example cowhide, pigskin, goatskin, or sheepskin, may be tanned by the process according to the invention.

OPERATING AND COMPARATIVE WORKING EXAMPLES

In the following Examples, all percentages are by weight and are based on the total weight of hides to be tanned, unless otherwise stated, and "mins."=minutes. The starting material for all examples was delimed and bated cowhides, with a thickness of 4 millimeters. The hides were initially immersed in water at 25° C., with weight of the water being equal to the weight of the hide. Additional materials were then added to and mixed with the water, pickling liquor, or tanning liquor formed by the successive additions, in amounts as shown for the specific examples below. After the elapse of the time shown to the right of each additive or group of additives for the specific examples below, the next additive or group of additives if any was then added. After exposure of the hides to these successively modified compositions of liquor for the times shown, the wet leather in the blue that resulted was removed from the liquor, put on a support ("horsed up"), and further processed in the manner usual in the art.

EXAMPLE 1 (COMPARATIVE)

(cf. "Das Leder" 34, 89–93 (1983)

| | |
|---|---|
| 1. 8% of sodium chloride | 10 mins. |
| 2. 0.7% of formic acid | 15 mins. |
| 3. 0.6% of sulfuric acid (The pH was 3.5 after this addition.) | 120 mins. |
| 4. 0.7% of electrolyte-stable sulfited fish oil and 0.3% of alkyl sulfate | 30 mins. |
| 5. 6% of a chrome tanning agent | 60 mins. |
| 6. 0.4% of MgO and 0.5% of a dicarboxylic acid mixture (The pH was 3.9 after this addition.) | 60 mins. |
| 7. 1.5% of Na aluminum silicate (The pH was 4.2 after this addition.) | overnight |

EXAMPLE 2 (COMPARATIVE)

(cf. DE-OS 35 16 842)

| | |
|---|---|
| 1. 8% of sodium chloride | 10 mins. |
| 2. 0.2% of sulfuric acid | 30 mins. |
| 3. 0.6% of glyoxylic acid (The pH was 4.5 after this addition.) | 90 mins. |
| 4. 0.7% of electrolyte-stable sulfited fish oil and 0.3% of alkyl sulfate | 30 mins. |
| 5. 4% of a chrome tanning agent | 60 mins. |
| 6. 0.2% of MgO (The pH was 4.5 and the temperature 45° C. | overnight |

-continued

| | |
|---|---|
| after this addition.) | |

EXAMPLE 3 (ACCORDING TO THE INVENTION)

| | |
|---|---|
| 1. 8% of sodium chloride | 10 mins. |
| 2. 0.7% of formic acid | 15 mins. |
| 3. 0.6% of sulfuric acid (The pH was 3.5 after this addition.) | 120 mins. |
| 4. 0.7% of electrolyte-stable sulfited fish oil and 0.3% of alkyl sulfate | 30 mins. |
| 5. 6% of a chrome tanning agent | 60 mins. |
| 6. 0.4% of MgO and 1% of glyoxylic acid (The pH was 3.9 after this addition.) | 60 mins. |
| 7. 1.5% of Na aluminum silicate (The pH was 4.5 and the temperature was 37° C. after this addition.) | overnight |

NOTES ON THE EXAMPLES

1. The density of the solution was 8° Baumé after the addition of sodium chloride in the first step of each example.
2. The formic and sulfuric acids used in each example were diluted with ten times their own volume of water before being added as shown; the weights given are for the concentrated acid. The glyoxylic acid used in Example 2 was dilute with three times its own volume of water before addition, but the weight given refers to the concentrated acid.
3. The chrome tanning agent used in each example contained chromium (III) salts stoichiometrically equivalent to 25% by weight of $Cr_2O_3$ in the tanning agent; of this total amount of chromium, 33% by weight was basic oxide and/or basic salt.

RESULTS OF THE EXPERIMENTS

The chromium oxide contents of the residual liquors from these three examples had the following values:

| | |
|---|---|
| Example 1 | 0.4 g $Cr_2O_3$/1 |
| Example 2 | 0.8 g $Cr_2O_3$/1 |
| Example 3 (invention) | 0.07 g $Cr_2O_3$/1 |

What is claimed is:

1. A process for converting animal hides into leather, comprising the steps of:

(A) pickling the hides in an aqueous solution of sulfuric acid, formic acid, or a mixture of sulfuric and formic acids;

(B) contacting the pickled hides with an aqueous tanning liquor having a pH value lower than about 3.5 and containing in solution an amount of chromium (III) salts equal to about 0.5 to about 12% by weight of the weight of the hides for a sufficient time to effect tanning;

(C) partially neutralizing at least the part of the tanning liquor utilized in step (B) that remains absorbed by the hides after step (B) with a first neutralizing agent selected from the group consisting of magnesium oxide, dolomite, an alkali metal carbonate, an alkali metal bicarbonate an alkaline earth metal carbonate or a mixture of any of these in the presence of at least one material selected from the group of aldehydo acids and keto acids, to produce a pH value for the partially neutralized tanning liquor within the range of about 3.6 to 4.3; and (D) further neutralizing at least that part of the partially neutralized tanning liquor that remains absorbed by the hides after step (C) by adding thereto a second neutralizing agent, selected from the group of alkali aluminum silicates, in sufficient amount to produce a pH value for the tanning liquor within the range from about 4.2 to about 5.5.

2. A process according to claim 1, wherein the amount of first neutralizing agent used is between about 0.3 and about 0.7% by weight of the weight of the hides, and the amount used of material selected from the group of aldehydo acids and keto acids is between about 0.3 and about 4.0% by weight of the weight of the hides.

3. A process according to claim 2, wherein the amount used of material selected from the group of aldehydo acids and keto acids is between about 0.5 and about 2.0% by weight of the weight of the hides.

4. A process according to claim 3, wherein the first neutralizing agent is magnesium oxide, dolomite, an alkali metal carbonate, an alkali metal bicarbonate, an alkaline earth metal carbonate, or a mixture of any of these.

5. A process according to claim 2, wherein the first neutralizing agent is magnesium oxide, dolomite, an alkali metal carbonate, an alkali metal bicarbonate, an alkaline earth metal carbonate, or a mixture of any of these.

6. A process according to claim 1, wherein the first neutralizing agent is magnesium oxide.

7. A process according to claim 5, wherein the first neutralizing agent is magnesium oxide.

8. A process according to claim 4, wherein the first neutralizing agent is magnesium oxide.

9. A process according to claim 8, wherein the acid selected in step (C) is glyoxylic acid.

10. A process according to claim 7, wherein the acid selected in step (C) is glyoxylic acid.

11. A process according to claim 6, wherein the acid selected in step (C) is glyoxylic acid.

12. A process according to claim 11, wherein the acid selected in step (C) is glyoxylic acid.

13. A process according to claim 5, wherein the acid selected in step (C) is glyoxylic acid.

14. A process according to claim 4, wherein the acid selected in step (C) is glyoxylic acid.

15. A process according to claim 3, wherein the acid selected in step (C) is glyoxylic acid.

16. A process according to claim 2, wherein the acid selected in step (C) is glyoxylic acid.

17. A process according to claim 1, wherein the acid selected in step (C) is glyoxylic acid.

18. A process according to claim 9, wherein the second neutralizing agents are selected from sodium aluminum silicates.

19. A process according to claim 1, wherein the second neutralizing agents are selected from sodium aluminum silicates.

* * * * *